United States Patent [19]

Poteat

[11] 4,021,004

[45] May 3, 1977

[54] SPOOL ASSEMBLY

[75] Inventor: George A. Poteat, Charlotte, N.C.

[73] Assignee: Engineered Plastics, Incorporated, Gibsonville, N.C.

[22] Filed: July 23, 1975

[21] Appl. No.: 598,409

Related U.S. Application Data

[63] Continuation-in-part of Ser. No. 461,309, April 16, 1974, abandoned.

[52] U.S. Cl. ..... 242/118.6

[51] Int. Cl.[2] ..... B65H 75/14

[58] Field of Search ..... 242/118.6, 118.61, 118.7, 242/118.4, 118.8, 77.3, 77.4, 77

[56] References Cited

UNITED STATES PATENTS

| | | | |
|---|---|---|---|
| 2,225,551 | 12/1940 | Clinton | 242/118.6 |
| 2,610,811 | 9/1952 | Moss | 242/118.61 |
| 3,650,494 | 3/1972 | Hutchinson | 242/118.61 |

FOREIGN PATENTS OR APPLICATIONS

| | | | |
|---|---|---|---|
| 460,596 | 10/1949 | Canada | 242/118.6 |
| 1,286,583 | 8/1972 | United Kingdom | 242/118.6 |

*Primary Examiner*—George F. Mautz
*Attorney, Agent, or Firm*—Richards, Shefte & Pinckney

[57] ABSTRACT

A spool assembly of simple, lightweight construction affording efficient, balanced, and inexpensive operation is constructed simply of a pair of end flanges secured to the ends of a hollow exterior tube on which material, such as carpet yarn, may be wound. The tube has interior, longitudinally extending, integral projections that provide longitudinal slots in which self-tapping screws are secured with the heads of the screws retained in the end flanges to secure the flanges on the tube. The slots may be formed by pairs of inwardly projecting walls with the walls retained against spreading by end reinforcing plugs disposed in the ends of the tubes and having peripheral notches that encompass and retain the projecting walls. Alternatively, an interior reinforcing core may be disposed in each end of the tube with radial arms extending partially into the slots for cooperation with the projecting walls to receive and retain the screws. In a variation of the construction, each slot-forming projection may be formed by an intermediate radially projecting wall and an end wall extending at a right angle to the intermediate wall, thereby forming a side-opening slot, and the end walls of the projections may be retained against spreading by end reinforcing plugs that support said end walls against radially inward movement. The tube may be structurally reinforced by intermediate plugs that may be mounted on a central tubular core that receives the spindle on which the spool assembly is to be mounted, or the interior of the assembly between the end flanges and between the central core and the exterior tube may be filled with expanded foam plastic for structural strength. In another embodiment one of the slot forming walls of each pair extends radially inwardly for mounting of the tube directly on a central core that has its ends flared between the extending walls or has wall engaging projections to prevent relative rotation.

19 Claims, 18 Drawing Figures

SPOOL ASSEMBLY

CROSS-REFERENCE TO RELATED APPLICATION

This application is a continuation-in-part of my co-pending U.S. Patent Application Ser. No. 461,309, filed Apr. 16, 1974, for SPOOL ASSEMBLY, now abandoned.

This application is related in general substance and purpose to the alternative spool assemblies of my invention which are disclosed and claimed in my co-pending U.S. Patent Application Ser. No. 391,555, filed Aug. 27, 1973, now U.S. Pat. No. 3,881,668, as a continuation-in-part of U.S, Patent Application Ser. No. 218,515, filed Dec. 26, 1972 now abandoned.

BACKGROUND OF THE INVENTION

The present invention relates to a spool assembly and more particularly to a spool assembly of the type having a hollow exterior tube to which end flanges are secured by fasteners retained in interior slots formed in projections on the exterior tube.

Conventional spool assemblies have solid cylindrical bodies that result in relatively expensive and heavy constructions, and because of their weight they demand relatively high power input and must be carefully balanced for effective application to a winding operation.

To avoid the disadvantages of solid spool assembly constructions, various hollow spool assemblies have been designed including those disclosed in Markle Canadian Patent No. 460,596, issued Oct. 25, 1949, Jones U.S. Pat. No. 3,614,018, issud Dec. 29, 1969, and Hutchinson U.S. Pat. No. 3,650,494, issued Mar. 21, 1972, all of which have either a central core or end plugs of special construction for primary attachment thereto of screws that have secondary threaded engagement in an exterior shell. A hollow tube construction is also shown in Clinton U.S. Pat. No. 2,225,551, issued Dec. 17, 1940, which shows solid ribs without slots, which ribs require precision machining of screw holes to align with the screw holes in the flanges in contrast to a fully extrudable tube with screw receiving slots extruded therein and accommodating some misalignment as in the present invention; further the Clinton patent discloses screw holes disposed so that the screws bite into the tube wall itself weakening the tube rather than being spaced from the wall as is possible with the present invention. The spool assembly of my aforementioned co-pending U.S. Patent Application Ser. No. 391,555 represents an improvement over these prior hollow spool assemblies in that it provides a lightweight, yet structurally strong, spider-shaped core on which an exterior tube is supported in a manner that does not require threaded screw engagement with the tube. On the other hand, the present invention provides a spool assembly wherein the end flange attachment is made in a unique manner directly to the exterior tube, with end reinforcement being provided if desired. Thus, the present invention also provides a spool assembly that is lightweight and inexpensive, and yet has necessary strength characteristics.

SUMMARY OF THE INVENTION

The advantages of the present invention are obtained by a unique construction wherein an exterior hollow tube is formed with inward projections that define fastener-retaining slots in which fasteners are secured to connect end flanges to the tube. This simple and inexpensive construction in itself provides adequate strength against radial compressive and longitudinal tension forces at the connection of the tube and end flanges, but end plugs of simple and inexpensive construction may be utilized in combination with the fastener-retaining slotted projections to enhance the compressive strength and the fastener retaining strength of the assembly.

Briefly described, the spool assembly of the present invention includes an exterior hollow tube formed for supporting material thereon and disposed between a pair of end flanges. The exterior tube has a plurality of interior, longitudinally extending, integral projections in the form of pairs of longitudinally extending walls with each pair defining with the tube a longitudinally open-sided fastener-retaining slot extending from adjacent the flanges. A plurality of fasteners are retained in the flanges and slots to secure the flanges to the ends of the tube. Preferably, the fasteners are self-tapping screws that are tapped into the tube projections at said slots without tapping into or distortion of the exterior tube wall and which have heads retained in the end flanges.

This exterior hollow tube construction with longitudinally extending projections is particularly adaptable to inexpensive manufacture as an integral extrusion, and the complete assembly, which may include a central tubular core for receiving a spindle on which the assembly is to be mounted, may be inexpensively strengthened by filling the interior with expandable foam plastic. The fastener-retaining tube projections may be formed by pairs of inwardly projecting walls that define slots opening inwardly or by radially projecting intermediate walls and end walls projecting at right angles therefrom to define slots opening sidewise. In either slot configuration the projections may be strengthened against fastener-releasing spreading and the tube end strengthened against compression by end reinforcing plugs that are disposed in the ends of the tubes in engagement with the interior surface thereof. When used with the inwardly opening slot projections the plugs are formed with peripheral notches aligned with and encompassing the projections to prevent spreading of the projections, and when used with the side opening slot projections the reinforcing plugs engage the end walls of the projections to prevent spreading. In addition to end plugs, intermediate reinforcing plugs shaped generally similar to the end plugs may be disposed in the exterior tube intermediate the ends thereof to provide further compressive strength.

As an alternative to the use of a peripherally notched end plug with the inwardly opening slot projections, a reinforcing core may be used that has radial arms extending into the slots, but only partially thereinto at the fastener locations, for fastener retaining engagement, and which extend fully into the slots beyond the fastener locations for compressive strengthening of the exterior tube.

In another embodiment of the invention the need for interior reinforcing plugs is eliminated and the exterior tube serves as its own support on the central core by having at least one wall of each pair of walls extending inwardly to provide support for mounting of the tube on a central core. Preferably these walls are flat and extend radially inwardly substantially the full length of the tube with inner ends disposed for engagement with the central core and prevented from relative rotation with respect thereto by rotation preventing means such as outward flaring at the ends of the core between the extending walls or by tube wall engaging projections upset from the central core intermediate its ends.

DESCRIPTION OF THE PREFERRED EMBODIMENTS

Figure 1:
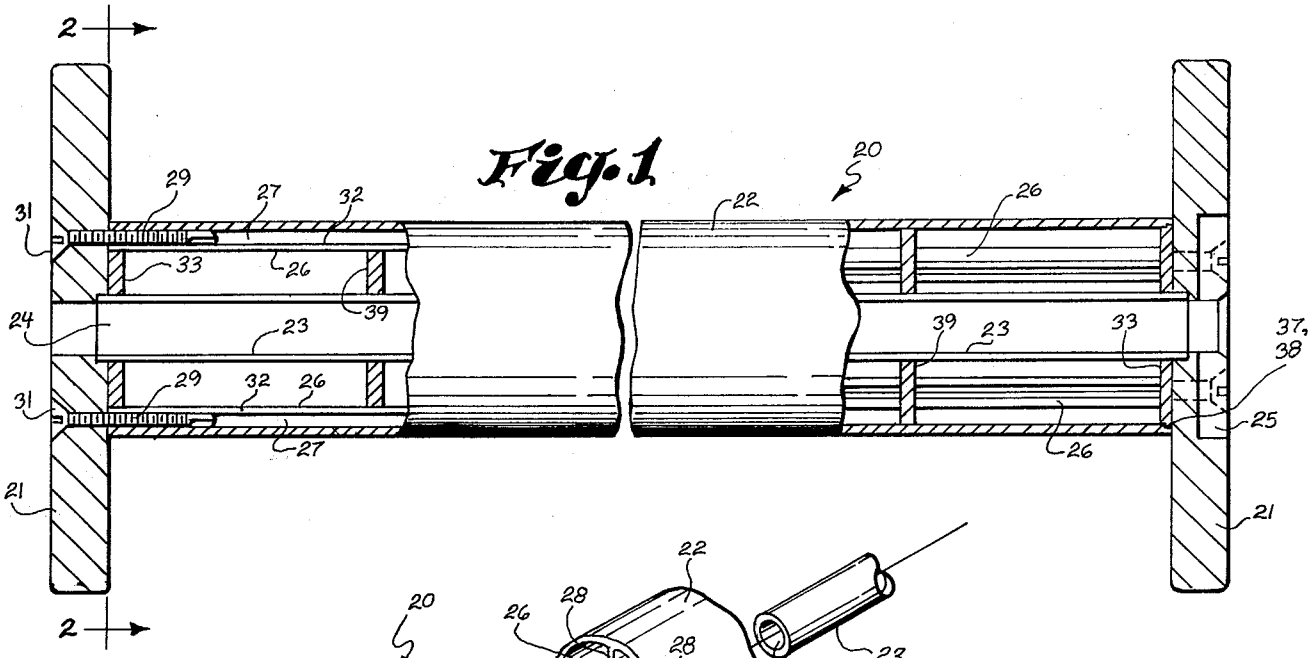
FIG. 1 is a side elevational view, partially in section, of a spool assembly according to one embodiment of the present invention, with the right half of the figure reoriented 90° with respect to the left hand to illustrate completely the interior thereof.
Figure 2:
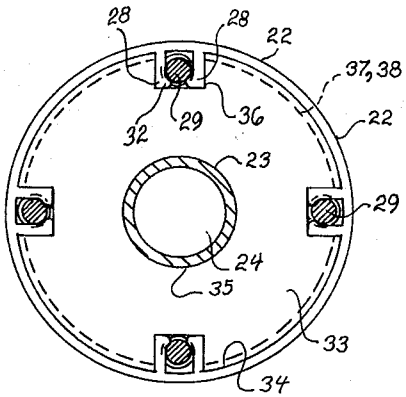
FIG. 2 is an enlarged vertical sectional view taken along line 2—2 of FIG. 1.
Figure 3:
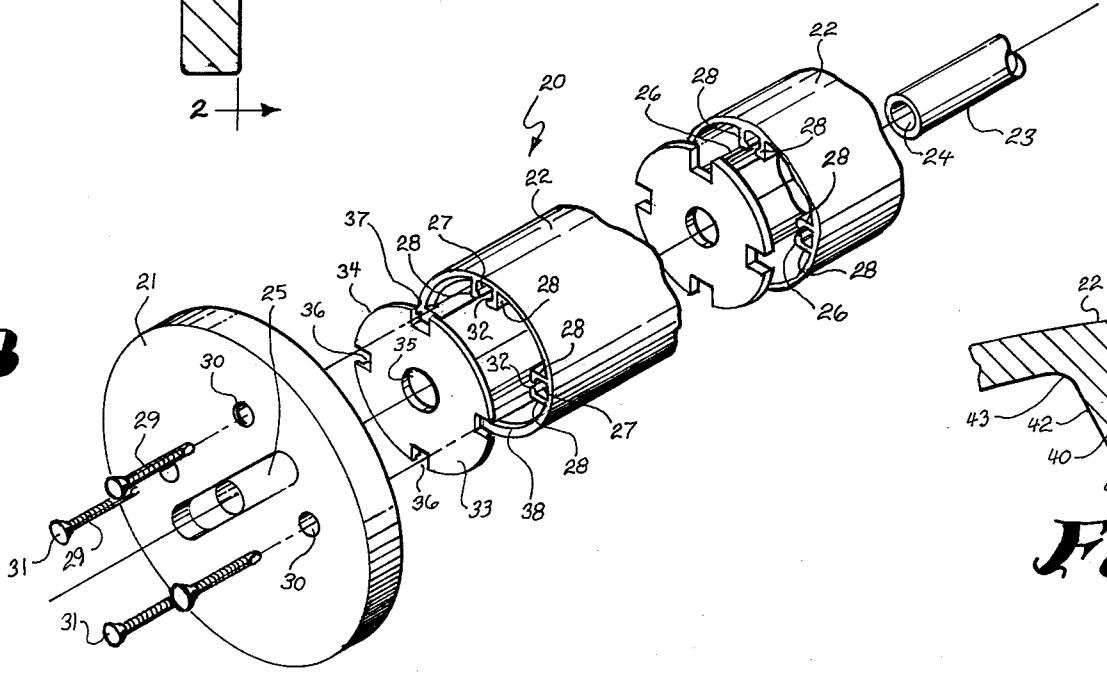
FIG. 3 is an exploded perspective view of the left half of the spool assembly of FIG. 1.

Referring first to the embodiment illustrated in FIGS. 1, 2 and 3, the spool assembly 20 is illustrated to be of the type used for winding of carpet yarn thereon, which winding operation of heavy yarn applies substantial compressive forces as well as substantial tension forces tending to spread or separate the ends of the spool assembly 20.

In this embodiment, the spool assembly 20 comprises a pair of end flanges 21 or wood, hard plastic or plastic-coated metal. These end flanges 21 are secured to the opposite ends of a hollow exterior tube 22 of relatively thin-walled, cylindrical construction, preferably formed as an extrusion of metal, such as aluminum. For mounting of the spool assembly 20 on a spindle mechanism, a central tubular core 23 extends between the end flanges 21 and has an axially extending cylindrical bore 24 sized for receiving a spindle on which the spool assembly 20 is to be mounted. The ends of the central core 23 are seated in the end flanges 21 to retain the core in place. To effect rotational drive of the spool assembly by the spindle mechanism, the end flanges 21 are formed with outwardly facing diametrical slots 25 that seat over drive projections on the spindle mechanism to transmit rotaion to the spool assembly.

The hollow exterior tube 22 is uniquely formed for attachment of the end flanges by having four circumferentially equally spaced interior projections 26 that extend longitudinally along the interior of the tube 22 throughout the full length of the tube, including adjacent the end flanges 21. This longitudinal extension of the projections 26 permits inexpensive fabrication by forming the projections integral with the tube during the extrusion operation, which also results in a strong attachment of the projections to the tube.

The projections 26 are formed to provide fastener-retaining slots 27 that extend longitudinally along the tube 22. In the embodiment of FIGS. 1, 2 and 3, each projection 26 is formed with a pair of radially inwardly projecting spaced side walls 28 that define the slot 27, which thereby opens inwardly toward the center of the spool assembly 20. The side walls 28 are spaced apart a distance generally equivalent to the minor diameter of attaching screws 29 that extend through holes 30 in the end flanges 21 aligned with the fastener-retaining slots 27. The screws 29 have heads 31 retained in the end flanges 21 and are of the self-tapping type so that they tap into the side walls 28 as they are screwed into the slots 27. Preferably, the screws 29 are located so that they do not tap into the wall of the tube 22 itself, but only into the projecting side walls 28, thereby avoiding possible distortion of the exterior surface of the tube 22. To facilitate retention of the screws 29 in the slots 27, the inwardly projecting ends of the side walls 28 are formed with facing protuberances or ridges 32 that reduce the size of the openings of the slot 27 for further support and tapped engagement by the screws 29.

In the embodiment of FIGS. 1, 2 and 3 the ends of the tube 22 are strengthened against compression and the slots 27 are strengthened against side wall spreading that could release the screw connection by the use of end reinforcing plugs 33 of generally circular configuration having an outer edge 34 in supporting engagement with the interior wall of the tube 22 and having an inner circular bore 35 for mounting of the plugs 33 on the central tubular core 23. Preferably the plugs 33 are formed of metal to provide desired strength.

Each end reinforcing plug 33 is formed with four equally circumferentially spaced, inwardly extending notches 36 having widths and depths sufficient to receive without significant clearance the projecting side walls 28 of the tube 22. Thus, these notches 36 are aligned with and encompass the fastener-retaining projections 26 to prevent lateral spreading during tapping of the screws 29 and after the screws are inserted. As a result, tension applied to the end flanges 21 tending to pull the screws 29 from the slots 27 by spreading the side walls 28 will be resisted by the retention of the side walls in the plug notches 36.

To retain the end reinforcing plugs 33 in proper position at the ends of the tube 22 and aginst the end flanges 21, the plugs 33 are formed with outwardly projecting annular shoulders 37 that extend into recesses in the ends of the inner wall of the tube 22 that provides a shoulder 38 in the tube 22 facing the shoulder 37 of the plug and retaining the plug in position.

The tube 22 may be strengthened in compression along its length, if desired, by the use of intermediate reinforcing plugs 39 that are shaped identical to the end reinforcing plugs 33, except that they do not include the outwardly extending shoulder 37 so that they can be inserted within the exterior tube 22 to selected locations. Because these intermediate plugs 39 have the same notched configuration as the end plugs 33, they are retained in proper radial disposition without tilting.

It is not necessary in all instances to use either intermediate reinforcing plugs 39 or end reinforcing plugs 33, and in some cases stengthening of the tube 22 may be accomplished by filling the interior with an expanded foam plastic material. Also the central tubular core 23 may be eliminated in some instances where spindle mounting can be accomplished otherwise, or the end plugs 33 may be extended in thickness to provide a substitute for the core, or short core sections may be mounted in the plugs 33. Further, fasteners other than self-tapping screws may be used, such as pins cemented in the tube slots 27.

Figure 4:
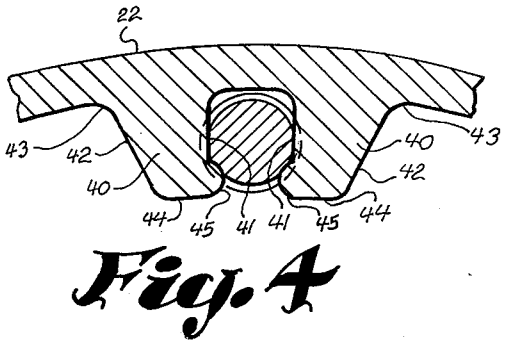
FIG. 4 is an enlarged sectional view of a portion of a modified exterior tube of the spool assembly of the present invention showing one pair of inwardly projecting slot-defining walls of the modified embodiment.

When no end reinforcing plugs 33 are used or when added strength of the side walls 28 is desired otherwise, the walls may be formed as shown in FIG. 4, wherein it is seen that each of the walls 40 are formed substantially thicker than the walls 28 of the embodiment of FIGS. 1, 2 and 3, and these thicker walls 40, while having straight radially projecting inner slot forming surfaces 41 have inclined outer surfaces 42 that provide a taper of the walls 40 from wide bases 43 at the interior of the tube 22 to narrow inner ends 44 from which facing ridges 45 project as in the side walls 28 of the embodiment of FIGS. 1, 2 and 3.

Figure 6:
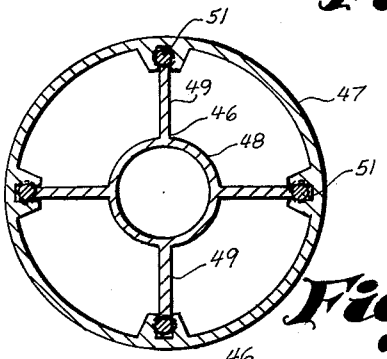
FIG. 6 is a vertical sectional view taken along line 6—6 of FIG. 5.
Figure 7:
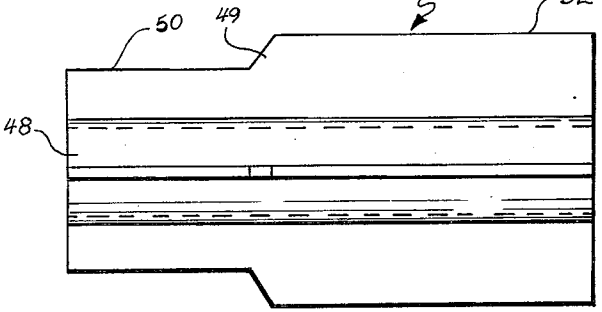
FIG. 7 is a side elevational view of the interior reinforcing core of the spool assembly embodiment of FIGS. 5 and 6.
Figure 5:
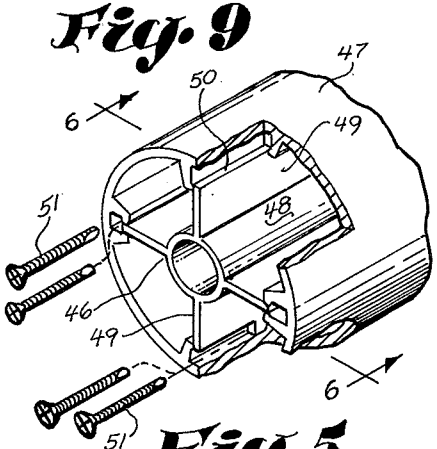
FIG. 5 is a perspective view partially in section, of one end of another embodiment of the spool assembly of the present invention, with the end flange and screws removed.
Figure 11:
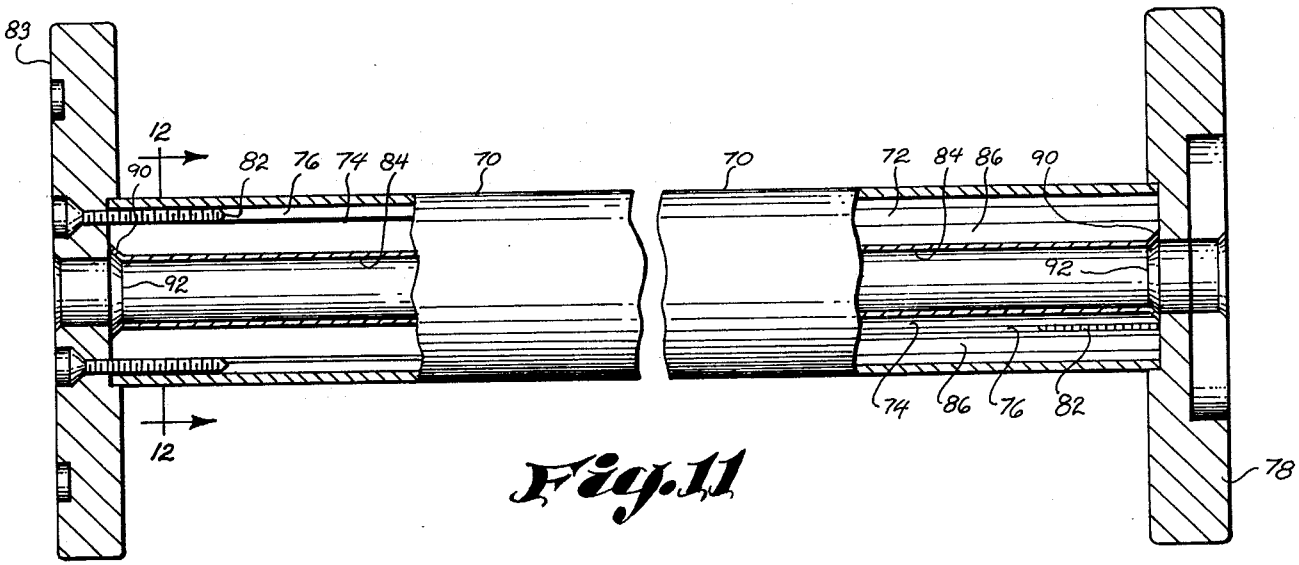
FIG. 11 is a view similar to FIGS. 1 and 8, showing an additional embodiment of the spool assembly of the present invention.
Figure 13:
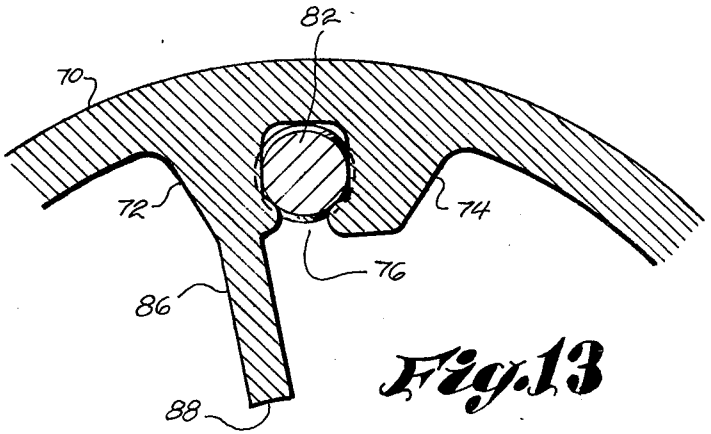
FIG. 13 is an enlarged sectional view of one pair of slot-defining walls of the embodiment of FIGS. 11 and 12.
Figure 12:
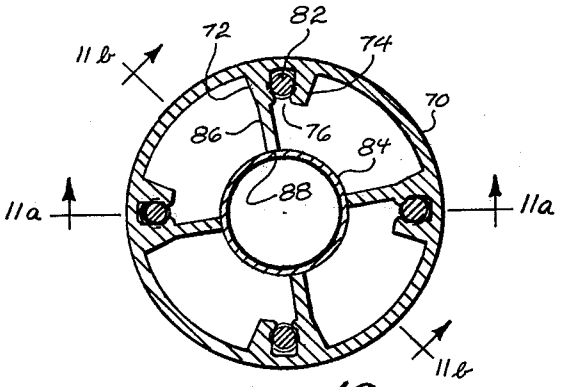
FIG. 12 is an enlarged vertical sectional view taken along line 12—12 of FIG. 11.

Rather than using end reinforcing plugs 33 of the type disclosed in the embodiment of FIGS. 1, 2 and 3, which may also be used in the embodiment of FIG. 4, an interior reinforcing core may be used in either embodiment. As seen in FIGS. 5, 6 and 7 in relation to the projecting wall construction of FIG. 4, this interior reinforcing core 46 is mounted in the end of the exterior tube 47. It has a tubular hollow central core portion 48 that is bored for mounting on a spindle and from which four equally circumferentially spaced radially extending arms 49 extend integrally into the slots between the walls 40 of the tube 47. Each of these arms 49 extends only partially into the slot between the walls 40 for an extent from the inner end of the exterior tube 47 for longitudinal extent equivalent to the extent of the fastener insertion and provides over this extent a fastener retaining surface 50 between the side wall ridges 45 generally in line with the minor diameter surface of the self-tapping screws 51 so that the screws will tap into the core arms 49 and be retained thereby against withdrawal. Inwardly of the extent of the screws 51, the core arms 49 extend, as at 52, fully into the slots between the tube side walls 40 to form a press fit therein for proper securement of the reinforcing core 46 at the end of the tube 47 and to provide strength for the tube against compression.

Figure 8:
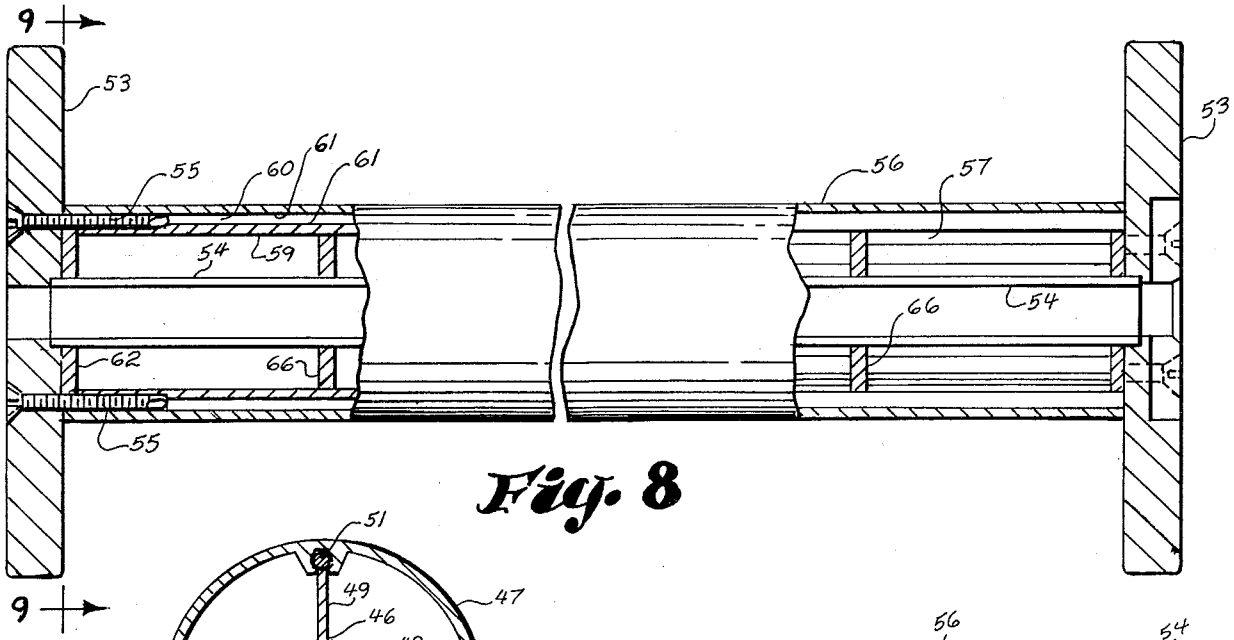
FIG. 8 is a view, similar to FIG. 1, showing a further embodiment of the spool assembly of the present invention.
Figure 10:
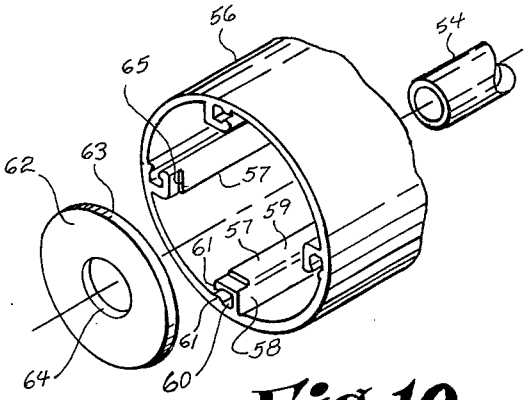
Fig. 10 is an exploded perspective view of the exterior tube, reinforcing plug and central core portions at the left end of the spool assembly of FIG. 8.
Figure 9:
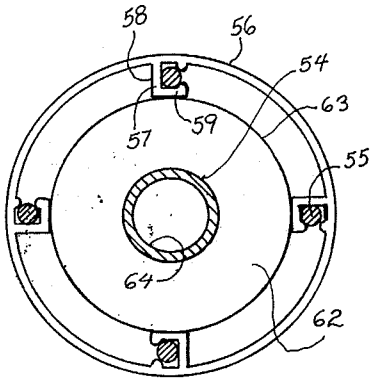
FIG. 9 is a vertical sectional view taken along line 9—9 of FIG. 8.

A further variation of the tube projection and reinforcing plug constructions of the present invention is shown in FIGS. 8, 9 and 10 wherein end flanges 53, a central tubular core 54, and self-tapping screws 55 indentical to those shown in FIGS. 1, 2 and 3 are utilized with a similar exterior tube 56 that differs in the configuration of the projections 57. These projections 57 are located in the same positions and for the same general purposes as the projections 26 of the embodiment of FIGS. 1, 2 and 3. Each of these projections 57 includes an intermediate wall 58 that projects radially inwardly from the inner surface of the exterior tube 56 and extends longitudinally the full length of the tube from adjacent the end flanges 53. An inner wall 59 extends generally at a right angle from the inner end of the intermediate wall 58 along the full length thereof to provide a fastener-retaining slot extending longitudinally and having a sidewise opening between the extending end of the inner wall 59 and the inner surface of the exterior tube 56.

The sidewise opening slots 60 retain the self-tapping screws 55, with the screws tapping into all three sides of the slots 60 and with facing protuberances or ridges 61 formed in the inner surface of the tube 56 and the facing end of the inner wall 59 to enhance screw retention.

Also to assure retention of the screws 55 in the slots 60, and particularly to prevent screw-loosening spreading of the inner wall 59 away from the inner surface of the tube 56, circular end reinforcing plugs 62 may be disposed in each end of the exterior tube 56 with outer circular surfaces 63 in supporting engagement with the inner walls 59 of the tube projections 57 to prevent inward movement thereof. These end reinforcing plugs 62 have central bores 64 to accommodate extension of the central tubular core 54 therethrough.

The end reinforcing plugs 62 are held in proper supporting position at the ends of the exterior tube 56 by inwardly projecting shoulders 65 formed on the inner walls 59 at a spacing from the ends of the tube 56 equivalent to the thickness of the end reinforcing plugs 62, thereby retaining the plugs between the shoulders 65 and the end flanges 53.

If intermediate support of the exterior tube 56 is desired, intermediate reinforcing plugs 66 may be utilized. These intermediate reinforcing plugs 66 are of the same general configuration as the end reinforcing plugs 62, except that they are of a sufficiently lesser diameter to be inserted past the inwardly extending shoulders 65 of the inner wall 59 while being of sufficient diameter to supportingly engage the inner surface thereof intermediate the ends of the tube 56.

An additional embodiment of the spool assembly of the present invention is illustrated in FIGS. 11-18. It eliminates the need for any reinforcing plugs and provides for support of the exterior tube directly on the central core, with the result that only four parts — exterior tube, central core and two end flanges — are needed to provide a strong, lightweight, and inexpensive spool assembly.

This embodiment is identical to the embodiment of FIGS. 5–8 except that the reinforcing core 46 of the FIGS. 5–8 embodiment is eliminated and extensions of the slot-forming walls provide the support for mounting on a central tubular core. In this embodiment the hollow exterior tube 70 has four equally circumferentially spaced pairs of radially inwardly projecting side walls 72 and 74 with the walls of each pair spaced apart to define fastener-retaining slots 76 in the same form as in the FIGS. 5–8 embodiment to attach end flanges 78 and 80 by screws 82 in the same manner as in the FIGS. 5–8 embodiment. However, to support the tube 70 directly on a central tubular core 84, one wall 72 of each pair extends radially inwardly as a flat strut 86 extending substantially the full length of the tube 70 and having an inner flat end 88 which provides supporting engagement with the central tubular core 84.

The inner ends 88 of the four wall extending struts 86 are dimensionally related to center the core 84 for proper support and dynamic balance. These ends 88 can be dimensioned and centered by machining, as with a broach or a spiral reamer or any other suitable tool.

Preferably the central tubular core 84 is prevented from rotating relative to the exterior tube 70 so that rotation imparted by a spindle on which the core is mounted will be transmitted to the tube for winding of yarn or the like thereon. The means for preventing relative rotation in the embodiment illustrated in FIGS. 11–15 is an upsetting or flaring 90 of the ends 92 of the core 84 between the ends 88 of the wall extensions 86 with the core ends 92 being flat or unflared at the locations 94 of the wall end engagement. Prevention of relative rotation could also be provided by forming other types of projections on the core 84 on opposite sides of the wall ends 88, or the core 84 could be spot welded to the wall ends 88.

Figure 18:
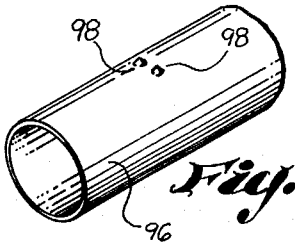
FIG. 18 is a perspective view of one end of the central core of the assembly of FIG. 16 showing the aforementioned means for preventing relative rotation.
Figure 17:
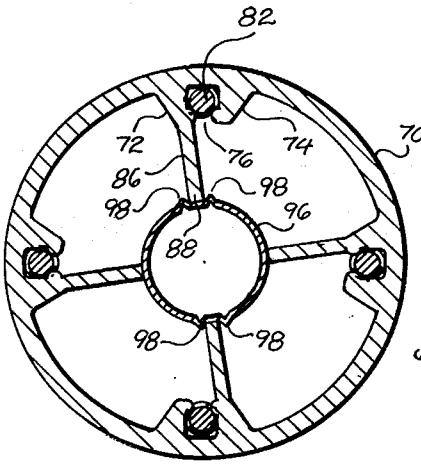
FIG. 17 is a view similar to FIG. 12, taken along line 17—17 of FIG. 16.
Figure 14:
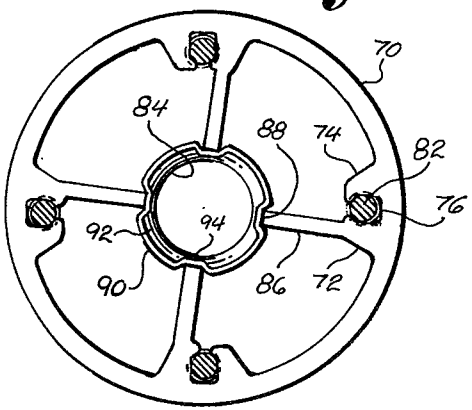
FIG. 14 is an enlarged vertical sectional view of the embodiment of FIGS. 11, 12 and 13 taken at the end of the central core with the adjacent flange removed.
Figure 15:
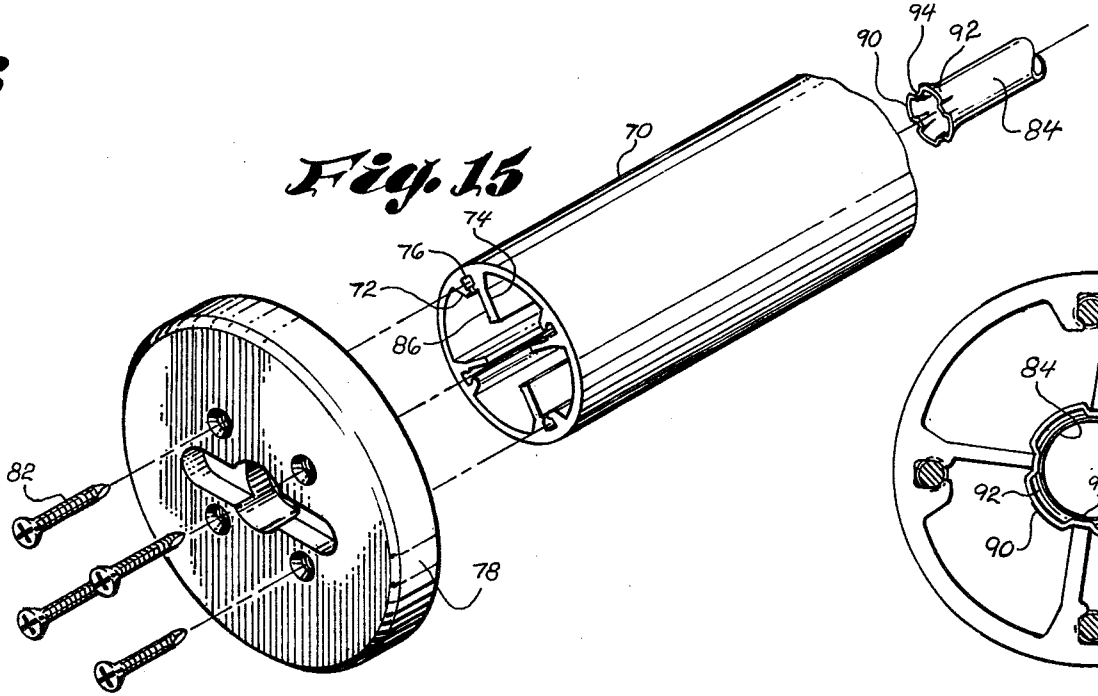
FIG. 15 is an exploded perspective view of the left end of the spool assembly of FIG. 11.
Figure 16:
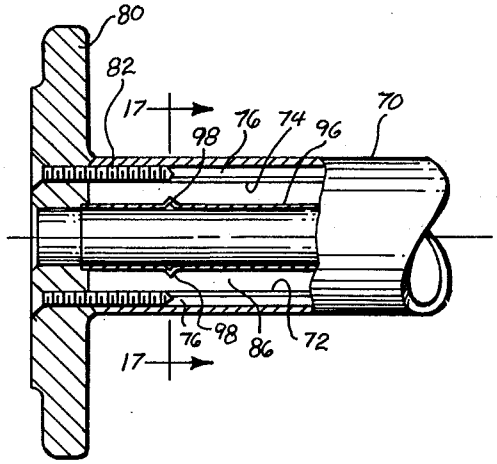
FIG. 16 is a view similar to the left end of FIG. 11 and showing a modified form of means for preventing relative rotation of the exterior tube and the central core.

In the form illustrated in FIGS. 16–18, the central core 96 has its ends cylindrical without flaring, and the means for preventing relative rotation constitutes pairs of upset projections 98 with the projections of each pair being spaced apart circumferentially equivalent to the width of the inner wall ends 88 to straddle the wall ends and prevent relative rotation. In the embodiment illustrated there are two pairs of projections 98 diametrically opposed to engage opposed wall ends 88. The other components illustrated in FIGS. 16–18 are identical to the corresponding components of the embodiment of FIGS. 11–15 and bear the same reference numerals with no further explanation being required.

In this regard, the central core 84 could be an extrusion of aluminum or plastic with longitudinal grooves or ribs engaging the wall ends to prevent relative rotation. Further, a core section or sections less than full length may be used to conserve weight and expense where full length strength is not needed other than that provided by the rigidification of the extending tube walls 86 themselves.

The present invention is capable of modification and variation within the intended scope thereof and it is to be understood that the foregoing detailed descriptions and drawings have been disclosed for illustrative purposes only and that the present invention is not intended to be limited in any way thereby, except as defined in the appended claims.

I claim:

1. A spool assembly comprising a pair of end flanges, an exterior hollow tube formed for supporting material thereon and disposed between said end flanges, said exterior tube having a plurality of interior, longitudinally extending, integral projections providing fastener-retaining slots extending from adjacent said flanges, a plurality of fasteners retained in said flanges and slots to secure said flanges to the ends of said tube, and end reinforcing plugs disposed in each end of said exterior tube in reinforcing engagement with the interior thereof, said plugs having peripheral notches aligned with and encompassing said projections adjacent said flanges to prevent spreading thereof and thereby retain said projections in fastener securing position.

2. A spool assembly according to claim 1 and characterized further in that said end reinforcing plugs have peripheral exterior shoulders and said exterior tube has peripheral interior shoulders engageable with said tube shoulders for seating of said plugs in the ends of said exterior tube.

3. A spool assembly according to claim 1 and characterized further by a central tubular core disposed interiorly of said exterior tube and supported between said flanges for receiving a spindle on which said spool assembly is to be mounted, and said end reinforcing plugs have central bores for mounting of said plugs on said central core adjacent said flanges.

4. A spool assembly according to claim 3 and characterized further by an intermediate reinforcing plug disposed in said exterior tube intermediate the ends thereof in reinforcing engagement with the interior surface thereof and having a central bore for mounting on said central core.

5. A spool assembly according to claim 4 and characterized further in that said intermediate plug has peripheral notches aligned with and encompassing said exterior tube projections for positioning of said intermediate plug in said exterior tube.

6. A spool assembly comprising a pair of end flanges, an exterior hollow tube formed for supporting material thereon and disposed between said end flanges, said exterior tube having a plurality of interior, longitudinally extending, integral projections providing fastener-retaining slots extending from adjacent said flanges, each of said projections comprising a pair of spaced, radially inwardly projecting, walls facing each other to define said slot therebetween, a plurality of fasteners retained in said flanges and slots to secure said flanges to the ends of said tube, and an interior reinforcing core at each end of said tube, said reinforcing core having a tubular central portion for receiving a spindle and from which a plurality of arms extend radially into the slots of said tube for reinforcing support thereof, said arms extending only partially into said slots for a longitudinal extent from said flanges generally equivalent to the extent of said fasteners in said slots to provide space for retention of said fasteners in securing engagement with said walls and with the extremities of said core arms.

7. A spool assembly according to claim 6 and characterized further in that said fasteners are self-tapping screws that are tapped into said projecting walls and the extremities of said core arms and have heads retained in said end flanges.

8. A spool assembly according to claim 6 and characterized further in that the portions of said core arms longitudinally inward of said fastener receiving space extend fully into said slots for radial reinforcing support of said exterior tube.

9. A spool assembly a pair of end flanges, an exterior hollow tube formed for supporting material thereon and disposed between said end flanges, said exterior tube having a plurality of interior, longitudinally extending, integral projections providing fastener-retaining slots extending from adjacent said flanges, each said projection comprising an intermediate wall projecting radially inwardly from said exterior tube and longitudinally from adjacent said end flanges, and an inner wall extending generally at a right angle from the inner end of said intermediate wall to provide said fastener-retaining slot extending longitudinally and having a sidewise opening between the end of said inner wall and said exterior tube, and a plurality of fasteners retained in said flanges and slots to secure said flanges to the ends of said tube.

10. A spool assembly according to claim 9 and characterized further by reinforcing plugs disposed in each end of said exterior tube and in supporting engagement with said inner walls of said slot forming projections to prevent inward movement thereof and thereby retain said inner walls in fastener securing position.

11. A spool assembly according to claim 10 and characterized further in that said inner walls of said projections are formed with radially inwardly projecting shoulders spaced longitudinally inwardly from said flanges substantially equivalent to the longitudinal extent of said reinforcing plugs and against which said reinforcing plugs seat for positioning thereof adjacent said end flanges in fastener retaining slot reinforcing position.

12. A spool assembly according to claim 10 and characterized further by a central tubular core disposed interiorly of said exterior tube and supported between said flanges for receiving a spindle on which said spool assembly is to be mounted, and said reinforcing plugs have central bores for mounting of said plugs on said central core adjacent said flanges.

13. A spool assembly according to claim 12 and characterized further by an intermediate reinforcing plug disposed in said exterior tube intermediate the ends thereof in reinforcing engagement with said inner walls of said projections and having a central bore for mounting on said central core.

14. A spool assembly comprising a pair of end flanges, an exterior hollow tube formed for supporting material thereon and disposed between said end flanges, said exterior tube having a plurality of interior, longitudinally extending, integral projections providing fastener-retaining slots extending from adjacent said flanges, each of said projections comprising a pair of spaced, radially inwardly projecting, walls facing each other to define said slot therebetween, at least one wall of each of said pairs of walls extending inwardly to provide support for mounting of said exterior hollow tube on a central core, and a plurality of fasteners retained in said flanges and slots to secure said flanges to the ends of said tube.

15. A spool assembly according to claim 14 and characterized further in that said exterior hollow tube is an extrusion with said slot-forming pairs of walls formed integral with said extrusion.

16. A spool assembly according to claim 14 and characterized further by a central tubular core engaged by said inwardly extending walls to support said exterior hollow tube thereon, and means for preventing relative rotational movement of said central tubular core with respect to said inwardly extending walls.

17. A spool assembly according to claim 16 and characterized further in that said means for preventing relative rotation comprises radially outwardly flared ends on said central tubular core between said inwardly extending walls for engagement therewith to prevent relative rotation.

18. A spool assembly according to claim 16 and characterized further in that said means for preventing relative rotation comprises a pair of projections formed on said central core, said projections being spaced apart circumferentially equivalent to the width of said inwardly extending walls and disposed for straddling one of said walls for engagement therewith to prevent relative rotation.

19. A spool assembly comprising a pair of end flanges, and exterior hollow tube formed for supporting material thereon and disposed between said end flanges, said exterior tube having a plurality of interior, longitudinally extending, integral projections providing fastener-retaining slots extending from adjacent said flanges, each of said projections comprising a pair of spaced, radially inwardly projecting, walls facing each other to define said slot therebetween, one wall of each of said pairs of walls extending radially inwardly and having a flat inner end disposed for engagement with a central core for support of said exterior hollow tube thereon, and a plurality of fasteners retained in said flanges and slots to secure said flanges to the ends of said tube.

* * * * *